US008225776B2

(12) United States Patent
Kawamura et al.

(10) Patent No.: US 8,225,776 B2
(45) Date of Patent: Jul. 24, 2012

(54) POWER UNIT FOR PORTABLE CHAIN SAW

(75) Inventors: Kunimune Kawamura, Fuchu (JP); Masato Nara, Nishitokyo (JP)

(73) Assignee: Yamabiko Corp., Tokyo (JP)

( * ) Notice: Subject to any disclaimer, the term of this patent is extended or adjusted under 35 U.S.C. 154(b) by 161 days.

(21) Appl. No.: 12/461,656

(22) Filed: Aug. 19, 2009

(65) Prior Publication Data

US 2010/0132679 A1 Jun. 3, 2010

(30) Foreign Application Priority Data

Dec. 3, 2008 (JP) ..... 2008-308867

(51) Int. Cl.
*F02P 3/02* (2006.01)
*F01P 1/00* (2006.01)

(52) U.S. Cl. ..... 123/635; 123/41.56

(58) Field of Classification Search ..... 55/437, 55/438

See application file for complete search history.

(56) References Cited

U.S. PATENT DOCUMENTS 5,363,815 A 11/1994 Pretzsch et al.
5,367,988 A * 11/1994 Collins ..... 123/41.65
5,542,380 A * 8/1996 Chatten ..... 123/41.7
5,738,064 A * 4/1998 Lowe et al. ..... 123/198 E

FOREIGN PATENT DOCUMENTS

JP 5896009 6/1983
JP 6287126 6/1987

OTHER PUBLICATIONS

English Abstract of Claim of 62-87126.
English Abstract of Claim of 58-96009.

* cited by examiner

*Primary Examiner* — Stephen K Cronin
*Assistant Examiner* — Sherman Manley
(74) *Attorney, Agent, or Firm* — Dykema Gossett PLLC

(57) ABSTRACT

A power unit for portable chain saws wherein an ignition coil is placed at a position so as to increase both the compactness and the cooling efficiency of the power unit.

A coil support on which the ignition coil is supported is formed integratedly with a crank case; adjacent to an open port; and on a part of an external periphery of the flywheel, said second part being not enclosed by the air-guiding passage.

The coil support extends from the crank case along a side of a muffler and forms an insulating gap from the muffler.

3 Claims, 3 Drawing Sheets

POWER UNIT FOR PORTABLE CHAIN SAW

FIELD OF THE INVENTION

The present invention relates to power units for portable hand-held chain saws.

BACKGROUND ART

A well-known portable hand-held chain saw (called as "portable chain saw" hereinafter) includes a power unit having a handle and a driven component which is mounted on the power unit and provided with a saw chain and a chain support that supports the saw chain.

The power unit is typically provided with an engine, a fuel tank, an oil tank, a power transmission and so forth in a compact configuration, and equipped with a handle for holding and maneuvering the chain saw with both hands.

For the portable chain saw operated while being held with the handles, there is a demand for more compact power units for higher maneuverability.

The power unit includes an air-cooled engine which is cooled by air generated by blades of air-cooling fan provided to a flywheel, guided through an air-guiding passage in a spiral manner so as to enclose part of the external periphery of the flywheel that rotates in accordance with the engine, and emitted from an open port of the air-guiding passage towards a cylinder of the engine.

At a top of the cylinder, a spark plug is mounted facing the internal combustion chamber inside the cylinder and is connected to one end of a high-voltage cable. The other end of the high-voltage cable is connected to an ignition coil.

The ignition coil is disposed on a periphery of the flywheel. As a permanent magnet disposed on the flywheel passes in front of the ignition coil, the electromotive force is generated in such a way that the ignition is synchronized with the rotation of the crankshaft.

In the power unit, the ignition coil is desired to be arranged so as not to degrade the air-guiding efficiency.

If the ignition coil is attached on the surface of the cylinder above the open port of the air-guiding passage, the air flow from the open port is obstructed by the ignition coil before reaching the cylinder, leading to insufficient cooling of the cylinder. Moreover, the ignition coil provided directly to the cylinder that is a heat source of the engine is subject to heat damage, degrading the ignition reliability.

On the other hand, if the ignition coil is arranged to the periphery of the flywheel so as not to affect the air flow, the cap of the oil tank inlet or the like should be placed away from the flywheel so as to ensure a space for the ignition coil. As a result, the compactness required for highly maneuverable power unit will be sacrificed.

SUMMARY OF INVENTION

In accordance with one aspect of the present invention, there is provided an ignition coil for a power unit of a chain saw in such a way as to improve the air-guiding efficiency of the air-guiding passage so as to ensure sufficient cooling of the cylinder, while preventing heat damage of the ignition coil and improving compactness, maneuverability and the maintenance feasibility of a portable chain saw.

In view of another aspect of this invention, there is provided a power unit for a portable chain saw including: a flywheel having blades; an air-guiding passage enclosing a first part of an external periphery of the flywheel and having an open port towards a cylinder of an engine; an ignition coil facing the external periphery of the flywheel; and a coil support integrated with a crank case and provided adjacent to the open port on a second part of an external periphery of the flywheel, said second part being not enclosed by the air-guiding passage, wherein the coil support extends from the crank case along a side of a muffler so as to form an insulating gap from the muffler.

Other advantages of the present invention will become apparent from the following detailed description, taken in conjunction with the accompanying drawings, illustrating by way of example the principles of the present invention.

DESCRIPTION OF THE PREFERRED EMBODIMENTS

Figure 1:
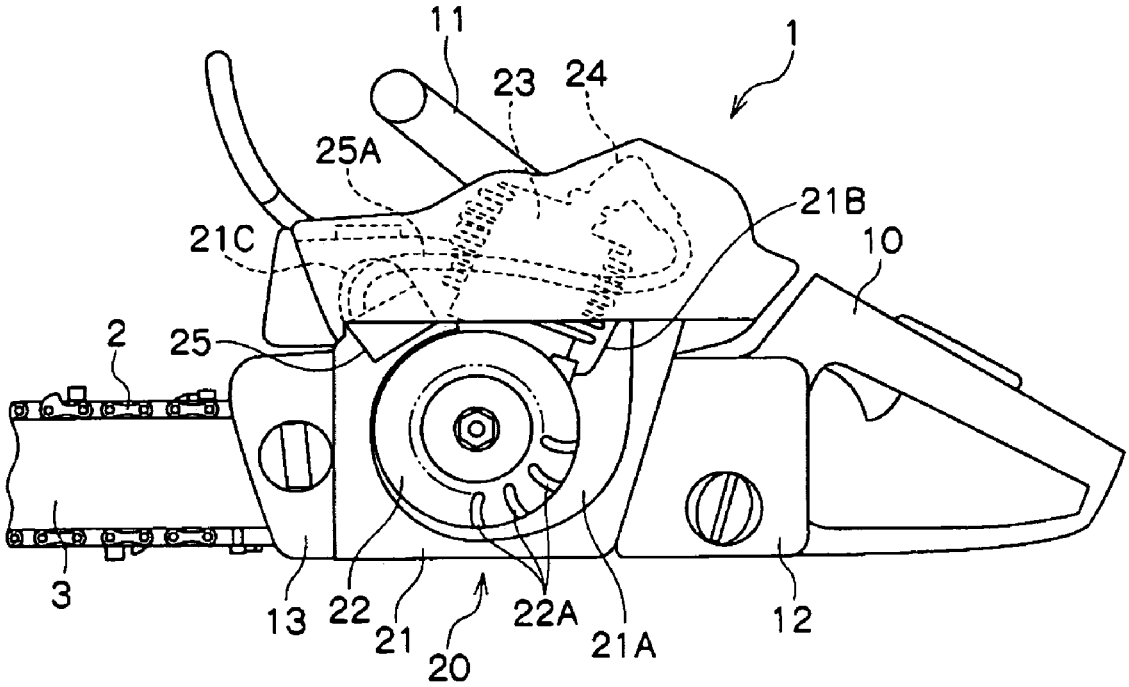
FIG. 1 is a plan view of a power unit of a portable chain saw with a crank case with its cover removed according to an embodiment of the present invention.
Figure 2:
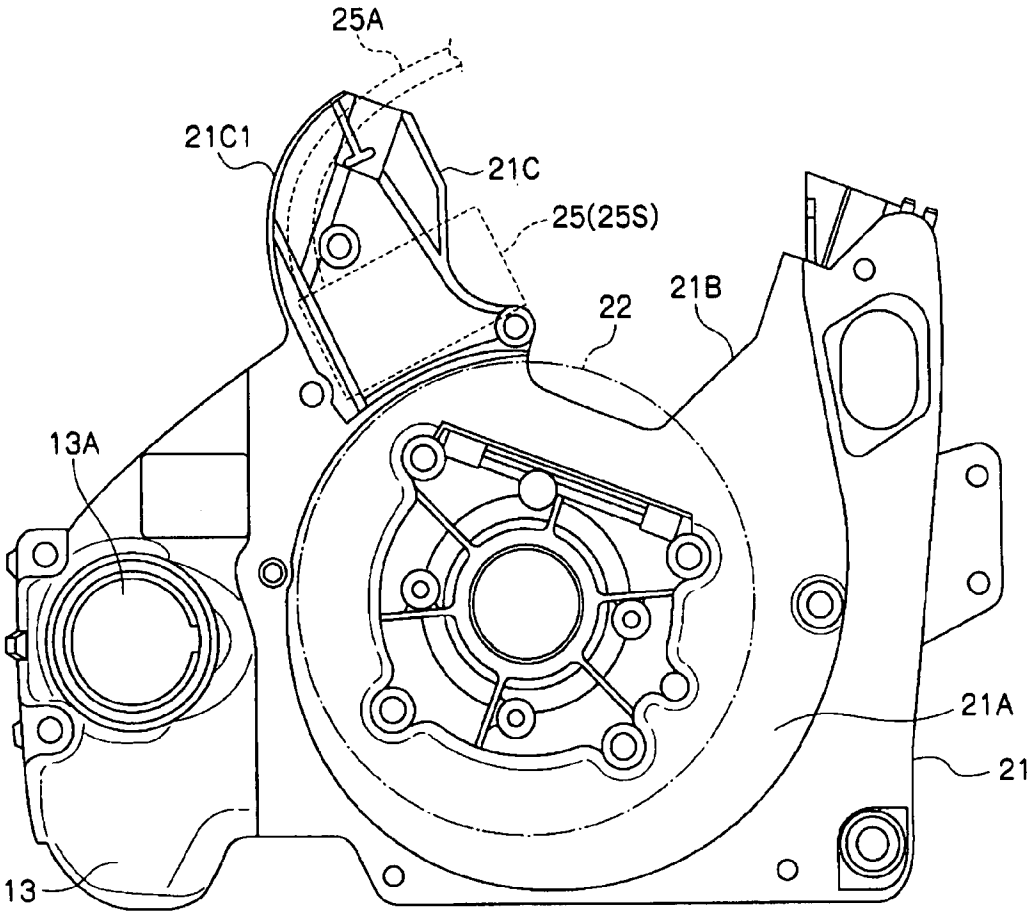
FIG. 2 is a plan view of the crank case housed in the power unit of the portable chain saw of FIG. 1.

Returning to FIG. 1, there is shown a portable chain saw which includes a power unit 1, a saw chain 2 driven by the power unit 1, and a chain support 3 according to a preferred embodiment of this invention. The power unit 1 includes a rear handle 10, a front handle 11, a fuel tank 12, an oil tank 13, an engine 20, and other components. The engine 20 comprises a crank case 21, a flywheel 22, a cylinder 23, a spark plug 24, an ignition coil 25, an electric cable 25A, and other components. Blades 22A for generating air flow are provided to the flywheel 22, and an air guiding passage 21A is formed in a spiral manner integrally with, or threadably attached to, the crank case 21 so as to enclose a first part of the external periphery of the flywheel 22 and form an open port 21B towards the cylinder 23, such that the top of the air guiding passage 21A is cut out, as also shown in FIG. 2.

The crank case 21 is a metal cast made of Al, Mg, or another metal. The air-guiding passage 21A widens gradually along the air flow direction from the starting point thereof to the open port 21B. The air flow generated by the blades with the rotation of the flywheel is guided along the air-guiding passage 21A and released from the open port 21B to reach the cylinder 23.

The ignition coil 25 is disposed so as to face a periphery of the flywheel 22, and the spark plug 24 is connected to one end of the electric cable 25A of the coil 25. Thus, the ignition by the spark plug 24 is synchronized with the rotation of the crankshaft by the electromotive force generated as a permanent magnet provided to the flywheel 22 passes in front of the ignition coil 25.

A coil support 21C on which the ignition coil 25 is supported is formed integratedly with the crank case 21; adjacent to the open port 21B; and on a second part of the external periphery of the flywheel, the part not enclosing the air-guiding passage 21A.

With the ignition coil 25, as shown by the broken lines in FIG. 2, placed to the coil support 21C, a side surface 25S of the ignition coil 25 is placed along the discharge direction on the outside of the open port 21B.

An oil tank 13 is attached to the front side of the crank case 21, and an inlet 13A of the oil tank 13 is placed adjacent to the external periphery of the flywheel 22.

Figure 3:
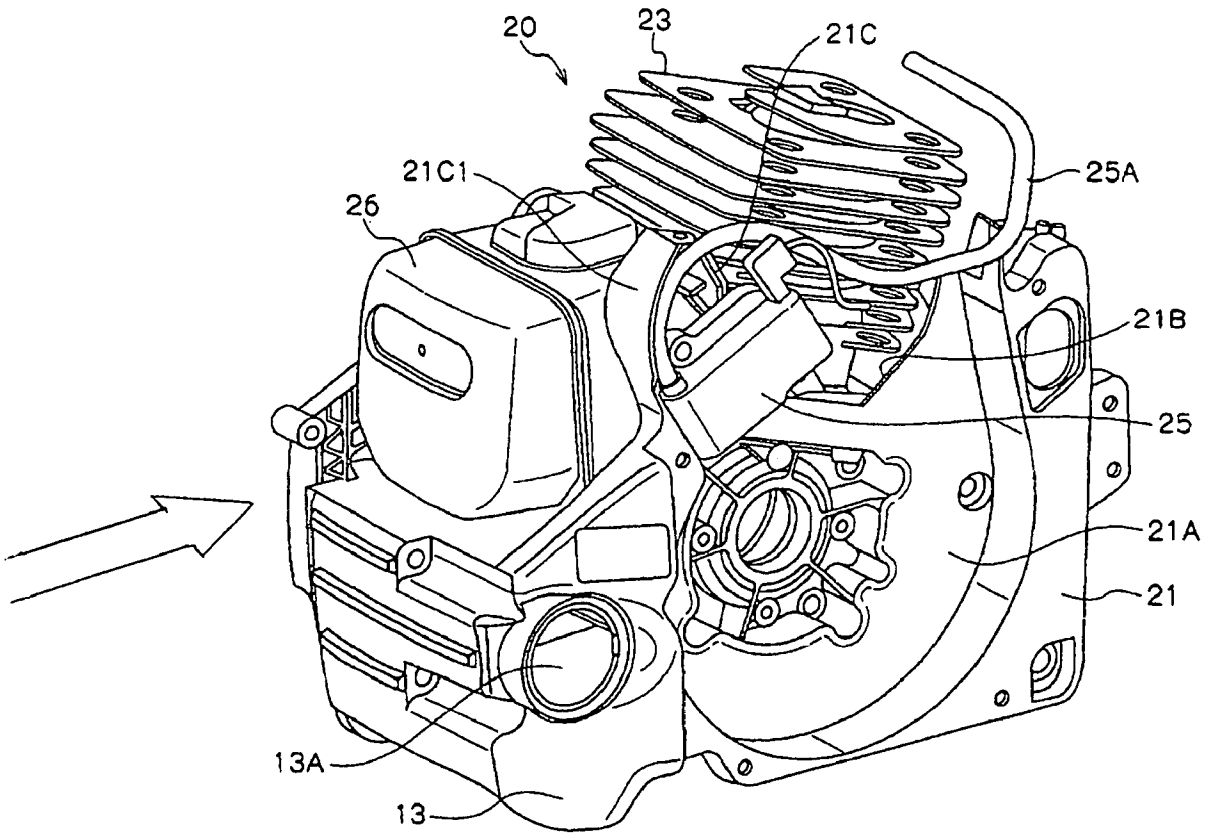
FIG. 3 is a perspective view of the power unit of the portable chain saw of FIG. 1.

As shown in FIG. 3, a muffler 26 is placed facing forward the engine 20. As the muffler 26 is connected to the exhaust port of the cylinder 23 so as to discharge exhaust gas from the engine 20, the muffler 26 and cylinder 23 serve as a heat source for the engine 20.

The coil support 21C extends from the crank case 21 along a side of the muffler 26 while forming an insulating gap 27 therebetween. Specifically, the coil support 21C extending upward in the drawing from the crank case 21 is formed so as not to contact a heat source, muffler 26, while extending into a space overlapping the muffler 26, so that the gap between the muffler 26 and the coil support 21C forms an insulating space. The coil support 21C according to this embodiment of the present invention allows the ignition coil 25 to be arranged so as to increase the air guiding efficiency and thereby the cooling performance of the cylinder 23.

In addition, the space above the muffler 26, in which the ignition coil 25 is conventionally not placed, is utilized, advantageously increasing the overall compactness of the power unit 1 and thereby the maneuverability of the chain saw.

Since the ignition coil 25 is supported directly by the crank case 21, the maintenance thereof is easy by removing the cover of the ignition coil.

The side surface of the ignition coil 25 arranged along the discharge direction on the external side of the open port 21B directs the air flow released from the air-guiding passage 21A in an effective manner towards the cylinder 23, which serves as the cooling of the ignition coil 25, too.

The coil support 21C has a rim 21C1 which encloses and protects the electric cable 25A and guides the same from the ignition coil 25 towards the spark plug 24. This prevents the electric cable 25A from being bent or broken, and increases the reliability of the ignition action.

The inlet 13A of the oil tank 13 is placed adjacent to the external periphery of the flywheel 22 so that the engine 20 and the oil tank 13 can be placed in proximity to each other, and the entire power unit 1 can be made more compact.

The preceding embodiments of the invention have been described for purposes of illustration and understanding only. Those skilled in the art will appreciate that other embodiments and variations of this invention exist, and that such embodiments and variations do not depart from the spirit of the invention as disclosed herein. Accordingly, the invention shall be limited in scope only by the attached claims.

What is claimed is:

1. A power unit for a portable chain saw, comprising an elongated crank case which extends in a longitudinal direction, an engine having a cylinder and an associated flywheel mounted in the crankcase such that an inner wall of the crank case defines an air guiding passage around a first peripheral portion of the flywheel, said air guiding passage having a open discharge port for directing air at a first side of said cylinder, a muffler mounted on said crank case so as to be spaced from a second side of said cylinder opposite said first side, an ignition coil, and a coil support connected to said crank case and supporting said ignition coil so as to be adjacent a second portion of said flywheel near said second side of said cylinder, said coil support extending upwardly and providing an insulating gap with a side of said muffler in a width direction of said crank case perpendicular to said longitudinal direction.

2. The power unit according to claim 1, wherein said ignition coil is box shaped and provides a side surface facing said open discharge port.

3. The power unit according to claim 1, wherein said ignition coil includes an electric cable and said coil support includes a rim which covers said electric cable.

* * * * *